US011013658B1

(12) United States Patent
Brawley

(10) Patent No.: US 11,013,658 B1
(45) Date of Patent: May 25, 2021

(54) MASSAGE APPARATUS WITH CIRCULAR PLATES

(71) Applicant: William Bruce Brawley, Wrightsville Beach, NC (US)

(72) Inventor: William Bruce Brawley, Wrightsville Beach, NC (US)

( * ) Notice: Subject to any disclaimer, the term of this patent is extended or adjusted under 35 U.S.C. 154(b) by 0 days.

(21) Appl. No.: 16/568,891

(22) Filed: Sep. 12, 2019

(51) Int. Cl.
*A61H 15/00* (2006.01)
*A63B 22/18* (2006.01)

(52) U.S. Cl.
CPC ..... *A61H 15/0092* (2013.01); *A63B 22/18* (2013.01); *A61H 2015/0014* (2013.01); *A61H 2201/0107* (2013.01); *A61H 2201/1261* (2013.01)

(58) Field of Classification Search
CPC ..... A61H 15/0092; A61H 2015/0014; A61H 2201/0107; A61H 2201/1261; A63B 22/18
See application file for complete search history.

(56) References Cited

U.S. PATENT DOCUMENTS

| | | | | |
|---|---|---|---|---|
| 6,763,538 | B1 * | 7/2004 | Tsai | A47G 9/1009 5/636 |
| 7,137,926 | B2 | 11/2006 | Barrows | |
| 7,481,783 | B1 * | 1/2009 | Kelley | A61H 15/0092 601/128 |
| 8,556,837 | B1 | 10/2013 | Poirier | |
| 8,821,352 | B2 | 9/2014 | Crowell et al. | |
| 9,415,258 | B1 * | 8/2016 | Higgins | A63B 21/0004 |
| 9,572,745 | B2 * | 2/2017 | Lin | A61H 15/0092 |
| D785,103 | S | 4/2017 | Townsend | |
| 9,693,929 | B2 | 7/2017 | Faussett | |
| 9,849,060 | B2 | 12/2017 | Ishibashi | |
| 10,137,055 | B2 | 11/2018 | Lawrie | |
| 10,765,594 | B2 * | 9/2020 | Sanchez | A61H 15/0092 |
| 2003/0004441 | A1 * | 1/2003 | Jelenc | A61H 9/005 601/15 |
| 2004/0024336 | A1 * | 2/2004 | Lin | A61H 15/0092 601/107 |
| 2006/0142677 | A1 | 6/2006 | Perez | |
| 2008/0200851 | A1 | 8/2008 | Faussett | |
| 2009/0176635 | A1 | 7/2009 | Brinson | |
| 2011/0152035 | A1 | 6/2011 | Wahl | |
| 2011/0257569 | A1 | 10/2011 | Robins | |

(Continued)

FOREIGN PATENT DOCUMENTS

| | | | |
|---|---|---|---|
| CN | 204766408 | U | 11/2015 |
| WO | WO2003006112 | A2 | 1/2003 |

*Primary Examiner* — Steven O Douglas

(57) ABSTRACT

A massage apparatus device with circular plates, which is compact enough to fit into a laptop bag yet versatile enough to engage the five elements of fitness training. It is an improvement over prior art that focuses on only one or two fitness elements. A top and bottom circular plate each having a tapered circular hole in the center of each plate and holes located around the circumference of each plate; and a flexible covering with rods wherein the rods removably engage the circular holes of each circular plate when folded in a cylindrical shape for massage. It is designed to easily disassemble and re-assemble. The top and bottom circular plates also function as double-sided discs used to perform exercises such as gliding. Further, the top and bottom circular plates when placed on a first and second ball are used to stand on to improve one's stability and coordination.

4 Claims, 5 Drawing Sheets

(56) References Cited

U.S. PATENT DOCUMENTS

| | | | | |
|---|---|---|---|---|
| 2012/0035029 | A1 | 2/2012 | Dye | |
| 2012/0065557 | A1 | 3/2012 | Phillips | |
| 2012/0310125 | A1* | 12/2012 | Hall | A61H 39/04 601/120 |
| 2012/0322633 | A1 | 12/2012 | Holman | |
| 2013/0096472 | A1 | 4/2013 | Bertram et al. | |
| 2013/0178766 | A1 | 7/2013 | Abdur-Raoof | |
| 2013/0178768 | A1 | 7/2013 | Dalebout et al. | |
| 2014/0128786 | A1 | 5/2014 | Ross | |
| 2018/0021211 | A1* | 1/2018 | Suokas | A61H 15/00 601/121 |

* cited by examiner

MASSAGE APPARATUS WITH CIRCULAR PLATES

1. FIELD OF THE INVENTION

The invention relates generally to a massage apparatus with circular plates.

2. BACKGROUND

Currently there are a number of solutions for an exercise tool whose emphasis is on flexibility. Some of these solutions attempt to incorporate strength and aerobic training as additional components. And then there are other devices that attempt to place their emphasis on balance. All of these solutions are incomplete due to the limited scope of the type of exercises they emphasize and facilitate when it comes to addressing the full spectrum of a complete fitness program.

It is desirable to have a device that is compact and portable and facilitates the performance of a wide variety of exercises. One that is both small in its overall size but also requires a small amount of floor space to fully utilize. Such a device is desirable to meet the needs of fitness-minded individuals who want to exercise when they travel, and compactness is an important consideration as well as for those whose residence is limited on space. It is also desirable to have a device that can be disassembled and re-assembled for ease of packing and transporting.

There exists a need in the exercise industry for a portable device that is both compact in its size and space required for use, as well as, comprehensive in the fitness elements it is designed to train. The disclosed device advantageously fills this need and addresses the aforementioned deficiencies by providing a portable multi-functional exercise device that can be utilized to address the five main fitness elements namely flexibility, balance, strength, core and aerobic fitness, and when utilized will maximize the training impact for the time invested. It is an improvement over prior art that focuses on only one or two fitness elements because it engages all five.

3. SUMMARY OF THE INVENTION

It is desirable to have a device that is compact and portable and facilitates the performance of a wide variety of exercises. One that is both small in its overall size and also requires a small amount of floor space to fully utilize. Furthermore, it would also be desirable to have a device that has multi-uses in order to have a lower overall cost. The top and bottom circular plates of the massage apparatus serve two additional functions, namely as balance trainers and exercise sliders. Still further, it would be desirable to have a device that is designed to train the five main fitness elements, namely, flexibility, balance, strength, core and aerobic fitness in a single device. There exists a need in the exercise industry for a portable device that is both compact in its size and space required for use, as well as, comprehensive in the fitness elements it is designed to train. The disclosed device advantageously fills this need and addresses the aforementioned deficiencies by providing a portable multi-functional exercise device that incorporates movements to address the five main fitness elements.

Disclosed is a massage apparatus with circular plates. These components are related as follows: A top and bottom circular plate that are identical and interchangeable with each having a tapered circular hole in the center and at least 8 holes located around the circumference; and 8 or more rods wherein each end of the rods removably engage the circular holes of each circular plate; and, a flexible covering wherein the rods are permanently affixed to its bottom side and located such that the rods removably engage the circular holes of each circular plate when folded in a cylindrical shape. The massage apparatus further comprising a top and a bottom circular disk attached to the top and the bottom circular plates and the tapered circular holes in the top and bottom circular plates able to receive a first and second ball removably placed in these tapered circular holes.

The device itself is not permanently secured with glue or fasteners so that it is intended to be taken apart and put together routinely. The rods are permanently affixed to the flexible covering and these rods removably engage the circular holes of the circular plates such that disassembly and re-assembly can be accomplished with ease.

The top and bottom circular plates also function as double-sided discs used to perform exercises such as gliding on hard or carpeted flooring and other related exercises. Further, the top and bottom circular plates when placed on a first and second ball are used to stand on to improve one's stability and coordination.

Prior art of special mention in this Summary includes U.S. Pat. Nos. 8,821,352 and 10,137,055. Unlike the present device, in U.S. Pat. No. 10,137,055, the outer skin is permanently attached to the support structure, and, the support structure is comprised of rigid discs that either pivot or fold in half so that the massager roller can convert from a flat configuration to an expanded configuration. The present device utilizes rods for its support structure as opposed to discs and these rods removably engage the circular holes of the circular plates to form a cylindrical shape as opposed to being permanently attached. Further, the present device has a top and bottom circular plate with a tapered circular hole in the center for receiving a first and second ball that the prior art does not have.

The prior art in U.S. Pat. No. 8,821,352 is a wrap for use with other exercise devices whereas the present device is an exercise device in and of itself and not intended to use in conjunction with other devices but rather as a standalone device. Additionally, the prior art has a hook and loop fastener for securing the wrap around an exercise device. The present device does not have any type of fastener system such as this. Further, the present device has a flexible covering with rods permanently affixed to its bottom side that removably engage the circular holes of the circular plates that the prior art does not have.

4. BRIEF DESCRIPTION OF THE DRAWINGS

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. A massage apparatus with circular plates may, however, be embodied in many different forms and should not be construed as being limited to the embodiments set forth herein; rather, these embodiments are provided by way of illustration only and so that this disclosure will be thorough, complete and fully convey understanding to those skilled in the art.

5. DETAILED DESCRIPTION

Figure 1:
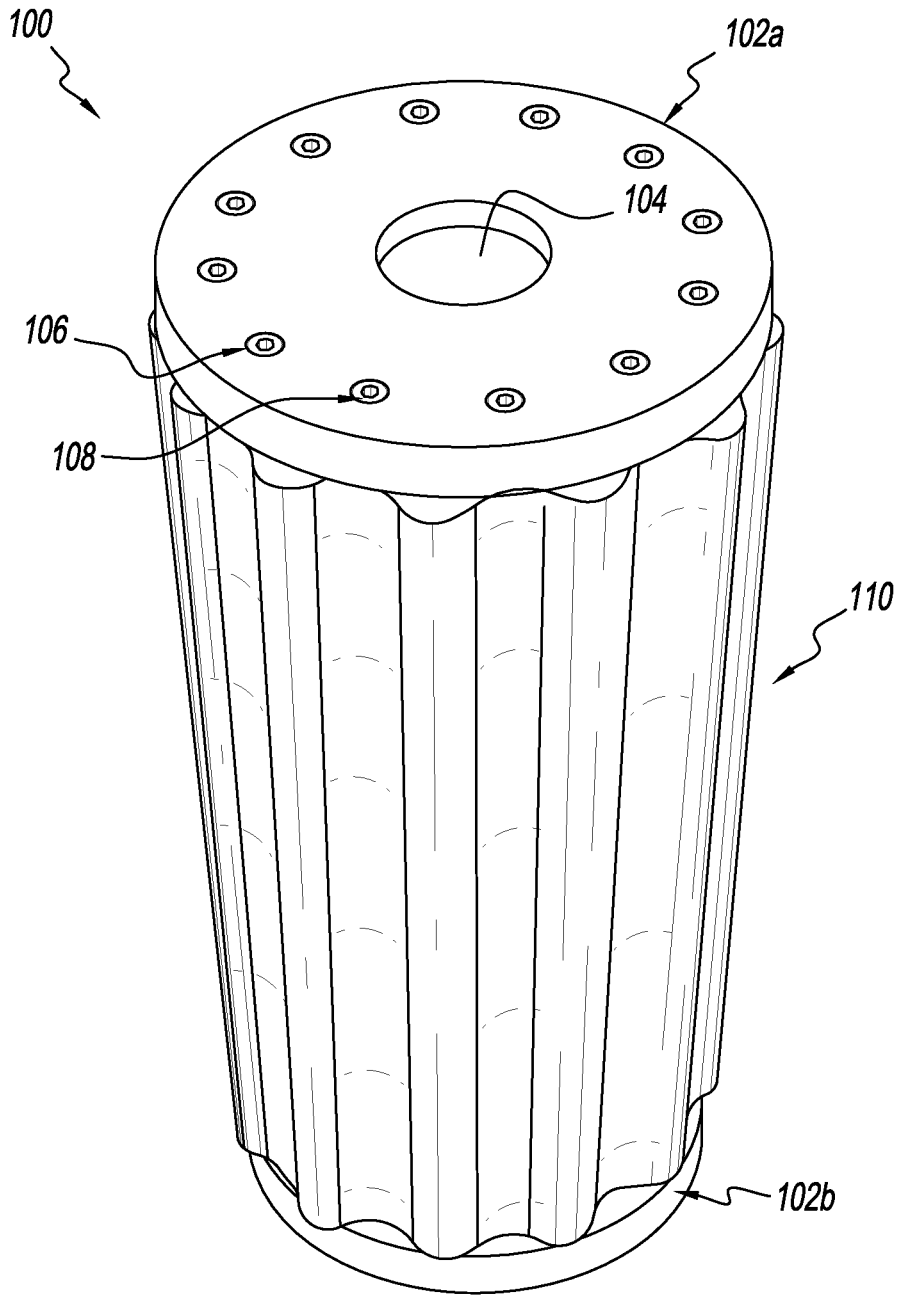
FIG. 1 is a front elevation showing an exemplary assembly of the massage apparatus with circular plates.

The present invention relates to an exercise device. With respect to the device, it is a massage apparatus with circular plates which is compact enough to fit into a laptop bag yet versatile enough to engage the five elements of fitness training namely, flexibility, balance, strength, core and aerobic fitness. This device can be used to perform a multitude of exercises that includes training movements for flexibility, balance, strength, core and aerobic fitness. It is an improvement over prior art that focuses on only one or two fitness elements because it engages all five.

These components are related as follows. A top and bottom circular plate that are identical and interchangeable with each having a tapered circular hole in the center and at least 8 holes located around the circumference; and 8 or more rods wherein each end of the rods removably engage the circular holes of each circular plate; and a flexible covering wherein the rods are permanently affixed to its inner facing and located such that the rods removably engage the circular holes of each circular plate when folded in a cylindrical shape. The massage roller further comprising a top and a bottom circular disk attached to the top and the bottom circular plates and the tapered circular holes in the top and bottom circular plates able to receive a first and second ball removably placed in these tapered circular holes.

The present device is not permanently secured with glue or fasteners so that it is intended to be taken apart and put together routinely. The rods are permanently affixed to the flexible covering and these rods removably engage the circular holes of the circular plates such that disassembly and re-assembly can be accomplished with ease.

The massage apparatus with circular plates is a cylinder made out of a flexible covering with rods with a circular plate on each end to hold the rods in position. The rods of the flexible covering are permanently affixed to its inner facing and these rods removably engage the circular holes of each circular plate. The device is not permanently secured with glue or fasteners so that it is intended to be taken apart and put back together routinely. It is designed to easily disassemble and re-assemble. Additionally, its individual components, namely the top and bottom circular plate and flexible covering with rods, take a very small volume of space for ease of packing or storing.

The device is used for exercises related to flexibility, balance, strength, core and aerobic fitness. One such movement for flexibility is to massage the thoracic spine region by placing the foam massage roller under your upper back from a lying position and rolling up and down the vertebrae of the upper back.

Additionally, the top and bottom circular plates also function as double-sided discs to perform exercises such as gliding on hard or carpeted flooring. They can be used for a multitude of strength, core and cardio exercises. One common exercise is mountain climbers. You begin this movement in a plank position on your hands with both feet on the exercise sliders. Place the side of the slider down that will best glide on the floor surface where you are exercising. Pull the right knee forward to your chest and then extend back to the start position. As the leg straightens, pull the opposite leg into your chest and repeat.

Further, the top and bottom circular plates when placed on a first and second ball are used to stand on to improve one's stability and coordination. Once each circular plate is resting on top of a first and second ball, begin by placing one foot at a time on top of the circular plate with your feet positioned shoulder-width apart. When fully supported by the circular plates, maintain a consistent position with your weight evenly distributed so that no part of either circular plate is touching the floor and the disc is level. Continue practicing this position until you can maintain it steadily for at least 1 minute. From here, begin incorporating more advanced movements such as squats and balancing on one leg.

6. DETAILED DESCRIPTION OF THE PREFERRED EMBODIMENTS

Disclosed are detailed descriptions of specific embodiments of the present invention namely, the massage apparatus with circular plates. It is understood that the disclosed embodiments are merely examples of the way in which certain aspects of the invention can be implemented and do not represent an exhaustive list of all the ways the invention may be embodied. It will be understood that the device and method described may be embodied in various and alternative forms. The figures are not necessarily to scale, and some features may be exaggerated or minimized to show details of particular components. Well-known components, materials or methods are not necessarily described in great detail in order to avoid obscuring the present disclosure. Any specific structural and functional details disclosed are not to be interpreted as limiting, but merely as a basis for claims, and as a representative basis for teaching one skilled in the art to employ the invention.

7. MECHANICAL

Referring to FIG. 1 a diagram is shown illustrating a perspective view from the front of the massage apparatus with circular plates 100 in accordance with an exemplary embodiment of the invention. It includes the top and bottom circular plates 102*a* and 102*b* with a tapered circular hole 104 in the center and 12 circular holes 106 located around the circumference of the top circular plate 102*a*. Illustrated inside the circular holes 106 in the top circular plate 102*a* are the rod ends 108 removably engaged in the circular holes 106. Further shown is the flexible covering with rods 110 positioned laterally between the top and bottom circular plates 102*a* and 102*b*. By way of further illustration, yet non limiting, the massage apparatus with circular plates 200 may be approximately 6 inches in diameter around the middle and 12 inches in length.

Figure 2:
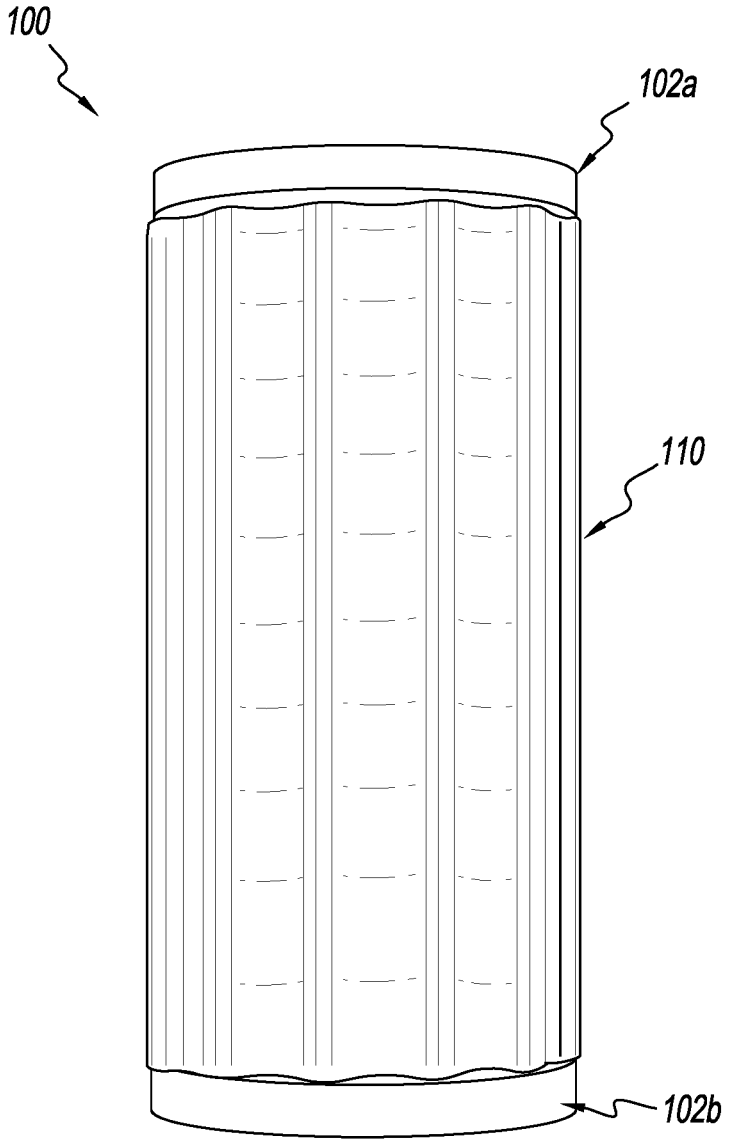
FIG. 2 is side elevation showing a longitudinal perspective of the massage apparatus with circular plates.

Referring to FIG. 2 is a further illustration of the massage apparatus with circular plates 100 showing an elevation view of the front in accordance with an exemplary embodiment of the invention. It includes the top and bottom circular plates 102*a* and 102*b* and the flexible covering with rods 110.

Figure 3:
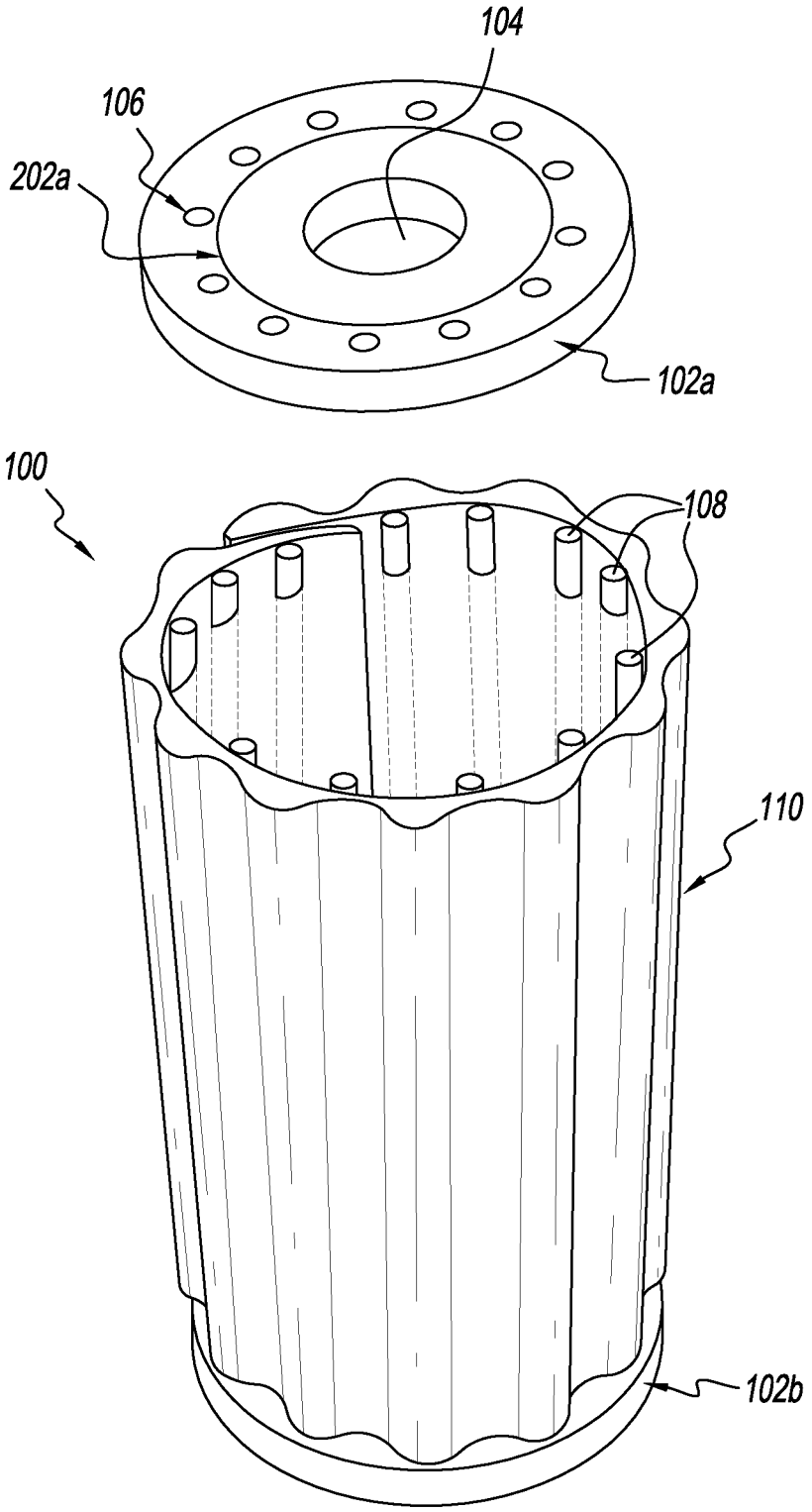
FIG. 3 is front elevation of the massage apparatus with circular plates with one circular plate removed exposing one end of the rods and flexible covering. Also shown is a top view of the circular plate showing the tapered circular hole, circular disk and the circular holes around its circumference.

Referring to FIG. 3 is a front elevation of the massage apparatus with circular plates 100 with the top circular plate 102*a* removed exposing one end of the rod ends 108 and the flexible covering with rods 110 in accordance with an exemplary embodiment of the invention. Also shown is a top view of the bottom side of the top circular plate 102*a* showing the tapered circular hole 104, top circular disk 202*a* and the circular holes 106 around its circumference. The top circular disk 202*a* may be comprised of a material such as but not limited to foam with a fabric facing.

Figure 4:
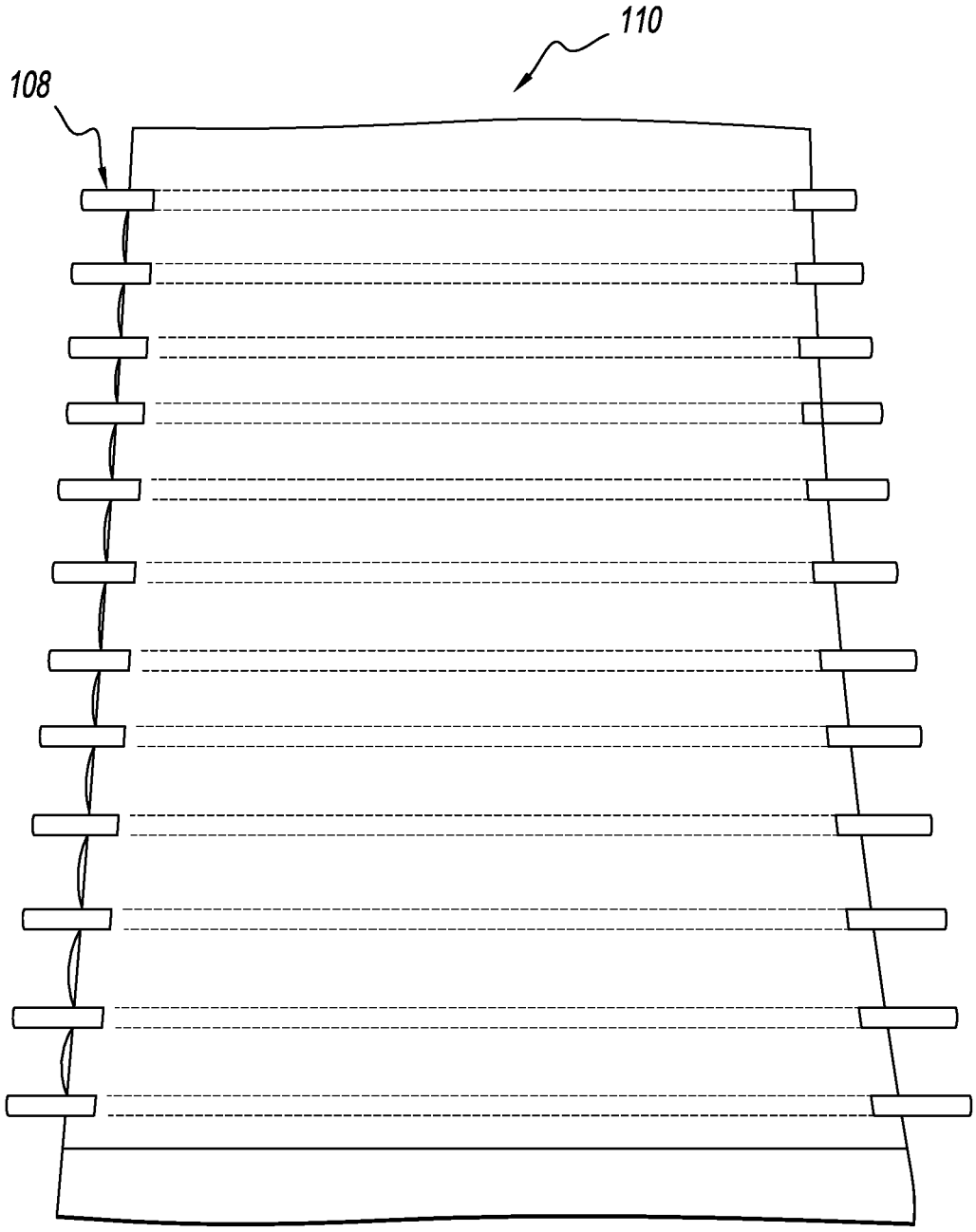
FIG. 4 is a top view of the inner facing of the flexible covering showing the permanently affixed rods.

Referring to FIG. 4 is a top view of the inner facing of the flexible covering with rods 110 showing the permanently affixed rods and rod ends 108. In one particular and illustrative, yet non limiting, embodiment of the flexible covering with rods 110, the rods may be comprised of a material such as but not limited to: fiberglass, wood or metal and the flexible covering may be comprised of a material such as but not limited to: foam, plastic or rubber.

Figure 5:
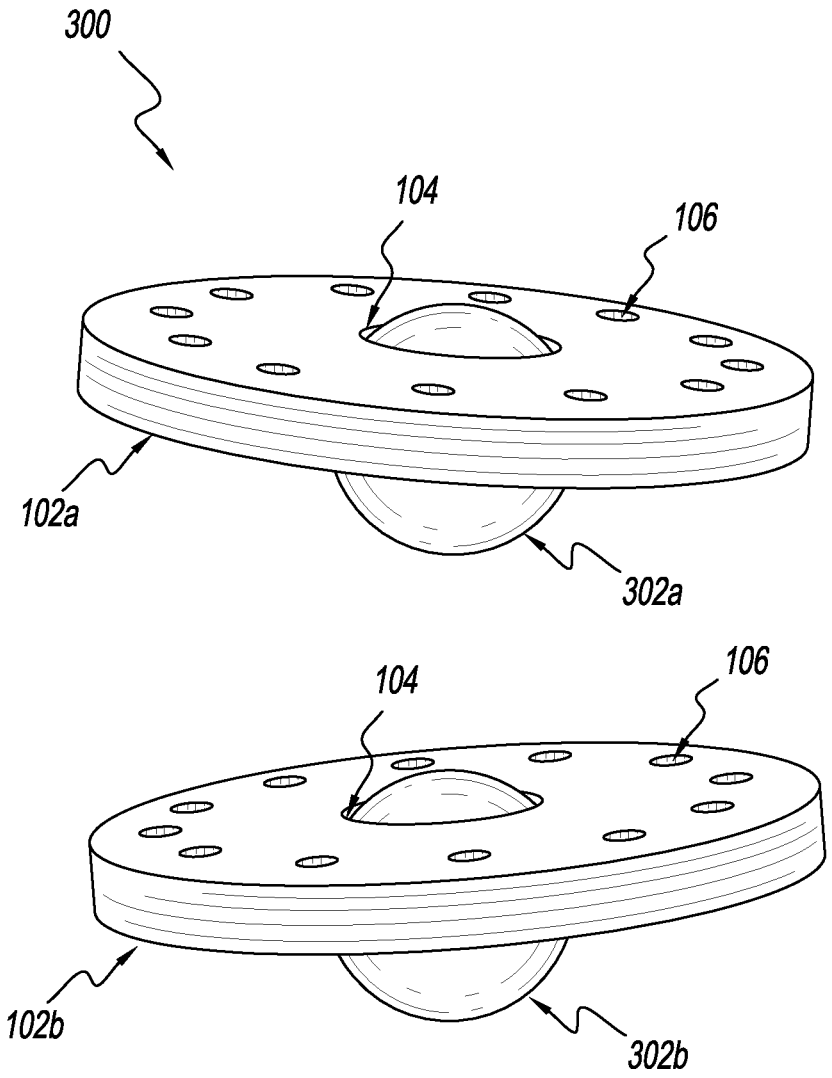
FIG. 5 is front elevation showing the top and bottom circular plates with the first and second balls placed in the tapered circular holes.

Referring now to FIG. 5 is a front elevation showing the top and bottom circular plates with the first and second ball 300. It includes the first and second balls 302*a* and 302*b* placed in in the tapered circular holes 104 of the top and bottom circular plates 102*a* and 102*b* and the circular holes 106 around the circumference of the top and bottom circular plates 102*a* and 102*b*. In one particular and illustrative, yet non limiting, embodiment of the top and bottom circular plates 102*a* and 102*b*, each may be approximately 6⅞ inches in diameter with a height of 11/16 inch and may be comprised of a material such as but not limited to: wood or molded plastic. The top and bottom circular plates with the first and second ball 300 is used to stand on to improve one's stability and coordination.

8. CONCLUSION

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art.

The invention claimed is:

1. A massage apparatus with circular plates comprising:

a top and bottom circular plate each having a tapered circular hole in the center of each plate and at least eight holes located around the circumference of each plate wherein the top and bottom circular plates are identical and interchangeable;

at least eight rods wherein each end of the rods removably engage the respective circular holes of each circular plate; and a flexible covering wherein the at least eight rods are permanently affixed to an inner facing thereof and located such that the rods removably engage the respective circular holes of each circular plate when the flexible covering is folded in a cylindrical shape.

2. The massage apparatus in claim 1, further comprising a top and a bottom circular disk attached to the top and the bottom circular plates.

3. The massage apparatus in claim 2, further comprising a first and second ball to be removably placed in the tapered circular holes.

4. The massage apparatus in claim 3, further comprising a first and second ball that are removed from the tapered circular holes.

* * * * *